US010952571B2

(12) United States Patent
Romnosky

(10) Patent No.: US 10,952,571 B2
(45) Date of Patent: Mar. 23, 2021

(54) ADDITIONAL TOILET PAPER ROLL HOLDER

(71) Applicant: Bill Romnosky, Plant City, FL (US)

(72) Inventor: Bill Romnosky, Plant City, FL (US)

( * ) Notice: Subject to any disclaimer, the term of this patent is extended or adjusted under 35 U.S.C. 154(b) by 28 days.

(21) Appl. No.: 16/195,850

(22) Filed: Nov. 20, 2018

(65) Prior Publication Data

US 2020/0154958 A1 May 21, 2020

(51) Int. Cl.
*A47K 10/38* (2006.01)
*A47K 10/32* (2006.01)

(52) U.S. Cl.
CPC ..... *A47K 10/38* (2013.01); *A47K 2010/3253* (2013.01)

(58) Field of Classification Search
CPC . A47K 10/22; A47K 2010/3253; A47K 10/38
USPC ..... 242/560, 560.2, 594, 594.5, 594.6
See application file for complete search history.

(56) References Cited

U.S. PATENT DOCUMENTS 2,025,732 A * 12/1935 Dodelin ..... A47K 10/3836 242/560
2,685,365 A * 8/1954 Sieven ..... A47K 10/38 206/410
2,790,608 A * 4/1957 Sieven ..... A47K 10/32 242/596.3
D204,595 S * 5/1966 Turro ..... D6/523
3,297,265 A * 1/1967 Turro ..... A47K 10/40 242/598.1
3,824,953 A * 7/1974 Boone ..... A47K 10/32 118/75
3,830,198 A * 8/1974 Boone ..... A47K 10/32 118/506
3,837,595 A * 9/1974 Boone ..... A47K 10/32 242/594.5
D252,842 S * 9/1979 McKee ..... D6/523
4,385,733 A * 5/1983 O'Keefe ..... A47K 10/38 211/106
4,427,159 A * 1/1984 Miller ..... A47K 10/38 242/560
4,834,316 A * 5/1989 DeLorean ..... A47K 10/32 242/594
5,012,986 A * 5/1991 Needle ..... A47K 10/38 242/560
D356,225 S * 3/1995 Coggins ..... D6/520
(Continued)

*Primary Examiner* — William E Dondero
(74) *Attorney, Agent, or Firm* — Cygnet IP Law, P.A.; Stephen W. Aycock, II

(57) ABSTRACT

An additional toilet paper roll holder is described. In some examples, the additional toilet paper roll holder can include a first elongated portion, a first curved portion, and a first end as well as a second elongated portion, a second curved portion, and a second end. The additional toilet paper roll holder can also include a support member. The support member can include a first slot and a second slot and can be configured to carry an additional toilet paper roll. The support member can also be configured to pass the first curved portion through the first slot and the second curved portion through the second slot. The first elongated portion with the first curved portion and the second elongated portion with the second curved portion can be configured to be connected through a support member resting on the first end and the second end.

20 Claims, 5 Drawing Sheets

(56) References Cited

U.S. PATENT DOCUMENTS

| | | | | | |
|---|---|---|---|---|---|
| 5,605,250 | A * | 2/1997 | Meiron | A47K 10/38 | 221/33 |
| D406,481 | S * | 3/1999 | Conrado | D6/520 | |
| 5,897,074 | A * | 4/1999 | Marino | A47K 10/38 | 242/594.1 |
| D452,094 | S * | 12/2001 | Akin | D6/515 | |
| 6,378,800 | B1 * | 4/2002 | Apichom | A47K 10/40 | 242/560 |
| 6,460,799 | B1 * | 10/2002 | Ryan | A47K 10/38 | 242/560.2 |
| D482,916 | S * | 12/2003 | Smurlick | D6/518 | |
| D506,632 | S * | 6/2005 | Holsclaw | D6/520 | |
| 6,945,493 | B1 * | 9/2005 | Gottesman | A47K 10/38 | 242/560.2 |
| D627,999 | S * | 11/2010 | Bostle | D6/523 | |
| D878,081 | S * | 3/2020 | Kaselau | D6/523 | |
| 2002/0185510 | A1 * | 12/2002 | Holsclaw | A47K 10/38 | 225/2 |
| 2018/0220852 | A1 * | 8/2018 | Grutzmacher | A47B 81/00 | |
| 2019/0231150 | A1 * | 8/2019 | Mueller | A47K 10/38 | |

* cited by examiner

ADDITIONAL TOILET PAPER ROLL HOLDER

FIELD

Some implementations relate generally to an apparatus for holding an additional toilet paper roll, i.e., an additional toilet paper roll holder apparatus.

BACKGROUND

Toilet paper roll holders are commonly used to carry toilet paper rolls. However, these holders typically have a provision for carrying only one toilet paper roll. As single toilet paper roll holders do not provide means for carrying a spare toilet paper roll, spare rolls are usually placed on the toilet tank, a wash basin or in cabinets located within the toilet room. A drawback of storing spare toilet paper rolls away from the toilet paper roll holder is that the spare toilet paper roll is not handy for replacing the existing toilet paper roll once it has been depleted.

The conventional techniques for storing spare toilet paper rolls are not convenient in certain situations. Examples of such situations include depletion of an existing toilet paper roll and the need to replace the existing toilet paper roll with a spare toilet paper roll right away.

It may be desirable to provide an additional toilet paper roll holder capable of holding a second toilet paper roll to enable convenient use of spare toilet paper rolls in varying situations. Some implementations were conceived in light of the above-mentioned needs, limitations, or problems, among other things.

SUMMARY

Some implementations include an additional toilet paper roll holder. An additional toilet paper roll holder can include a first elongated portion connecting a first curved portion to a first end. The additional toilet paper roll holder can include a second elongated portion connecting a second curved portion to a second end. The first elongated portion with the first curved portion and the second elongated portion with the second curved portion can be configured to be connected through a support member resting on the first end and the second end.

The support member can include a first slot and a second slot and can be configured to carry the additional toilet paper roll. The support member can be configured to pass the first curved portion through the first slot and the second curved portion through the second slot. The support member can be in at least one of pyramidal, cylindrical, cube, cuboid, conical and prism shapes. The first curved portion and the second curved portion can be in the shape of at least one of a hook and a ring. The first curved portion and the second curved portion can each wrap around a toilet paper roll holder or around an arm of the holder.

The first elongated portion, the first curved portion and the first end can form a single integrated unit without one or more joints, interfaces, connections, or attachments. The second elongated portion, the second curved portion and the second end can form a single integrated unit without one or more joints, interfaces, connections, or attachments.

The first elongated portion and the second elongated portion can be made of at least one of plastic, metal, wood, stone, composite, synthetic, thermoplastic, rubber, textile, plant fiber, natural and man-made materials. The first curved portion and the second curved portion can be made of at least one of plastic, metal, wood, stone, composite, synthetic, thermoplastic, rubber, textile, plant fiber, natural and man-made materials. The first end and the second end can be made of at least one of plastic, metal, wood, stone, composite, synthetic, thermoplastic, rubber, textile, plant fiber, natural and man-made materials. The support member can be made of at least one of plastic, metal, wood, stone, composite, synthetic, thermoplastic, rubber, textile, plant fiber, natural and man-made materials.

An additional toilet paper roll holder can include a first elongated portion connecting a first curved portion to a first end. The additional toilet paper roll holder can also include a second elongated portion connecting a second curved portion to a second end. A support member with a first slot and a second slot can be configured to be placed on the first end and the second end by passing the first curved portion through the first slot and the second curved portion through the second slot. The first elongated portion, the first curved portion and the first end can form a single integrated unit without one or more joints, interfaces, connections, or attachments. The second elongated portion, the second curved portion and the second end can form a single integrated unit without one or more joints, interfaces, connections, or attachments.

A method for carrying an additional toilet paper roll can include inserting a support member into a core of an additional toilet paper roll, passing a first slot of the support member through the first curved portion and a second slot of the support member through the second curved portion such that the support member (along with the additional toilet paper roll) rests on a first end and a second end, and wrapping a first curved portion and a second curved portion around a toilet paper roll holder. The first curved portion can be connected to the first end via a first elongated portion and the second curved portion can be connected to the second end via a second elongated portion. The first elongated portion, the first curved portion and the first end can form a single integrated unit without one or more joints, interfaces, connections, or attachments. The second elongated portion, the second curved portion and the second end can form a single integrated unit without one or more joints, interfaces, connections, or attachments.

DETAILED DESCRIPTION

Figure 1:
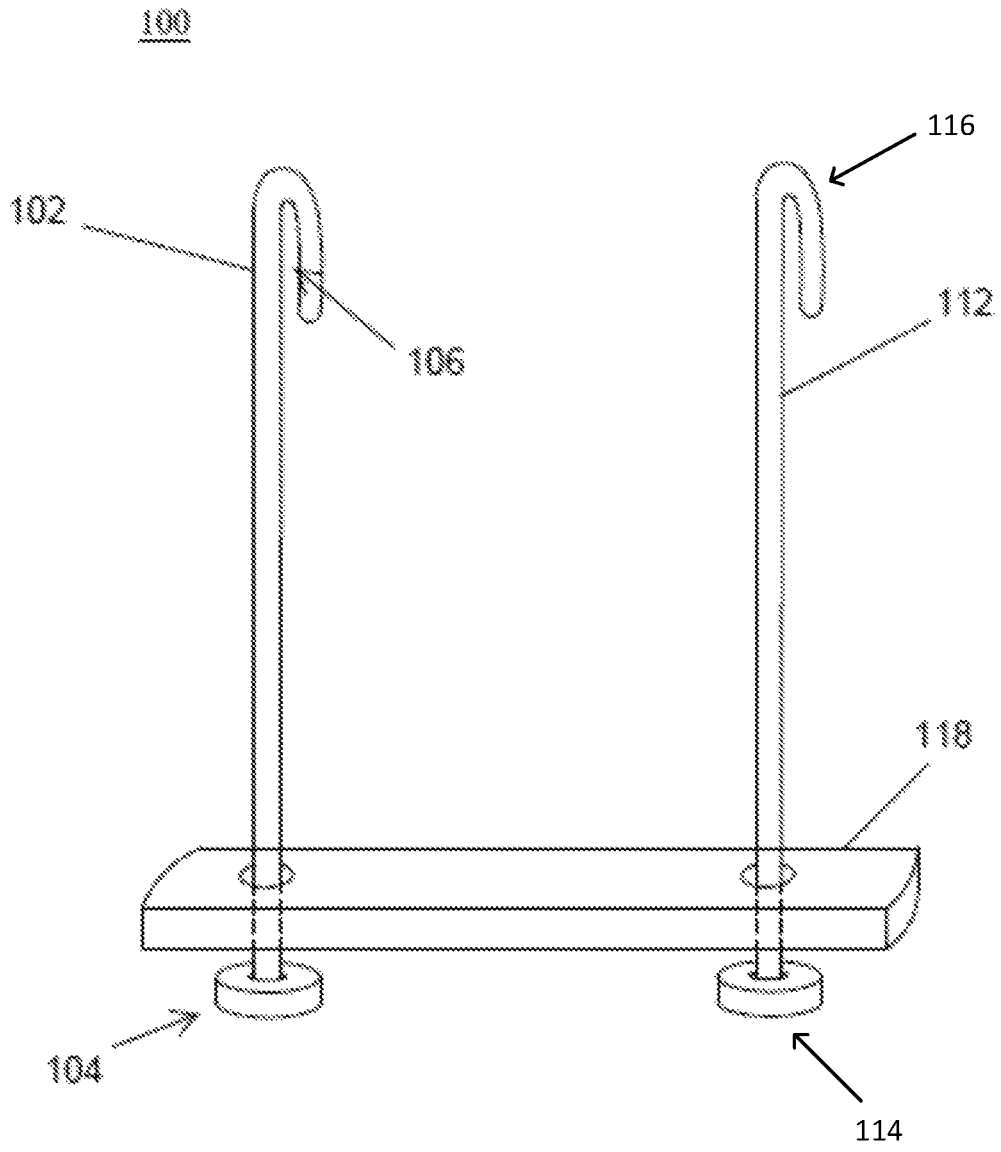
FIG. 1 is a diagram showing a front elevation view of an example additional toilet paper roll holder in accordance with some implementations.

FIGS. 1-5 show diagrams of an example additional toilet paper roll holder (e.g., 100). As shown in FIG. 1, an example additional toilet paper roll holder 100 includes a first elongated portion 102, a first curved portion 106 and a first end 104 as well as a second elongated portion 112, a second curved portion 116 and a second end 114. The example additional toilet paper roll holder 100 can also include a support member 108 with a first slot 110 and a second slot 120.

In some implementations, the first curved portion 106 and the second curved portion 116 are shaped in the form of a hook. In some other implementations, the first curved portion and the second curved portion are shaped in the form of a ring. The first curved portion and the second curved portion described herein are for illustration purposes only, not intended to be limiting, and can take other shapes, forms, and sizes depending on a contemplated implementation.

In some implementations, the first curved portion 106 and the second curved portion 116 are configured to wrap around a toilet paper holder. In some other implementations, the first curved portion and the second curved portion are configured to wrap around an arm of a toilet paper holder. In yet other implementations, the first curved portion and the second curved portion are configured to wrap around a frame/fixture to which a toilet paper holder is attached.

The first elongated portion 102 and the second elongated portion 112 described herein are for illustration purposes only, not intended to be limiting, and can take other shapes, forms, and sizes depending on a contemplated implementation.

In some implementations, the first end 104 and the second end 114 are shaped in the form of a cylinder. In some other implementations, the first end and the second end are shaped in the form of a cuboid or cube. The first end and the second end can also be shaped in the form of a prism or a pyramid. The first end and the second end described herein are for illustration purposes only, are not intended to be limiting, and can take other shapes, forms, and sizes depending on a contemplated implementation.

Figure 2:
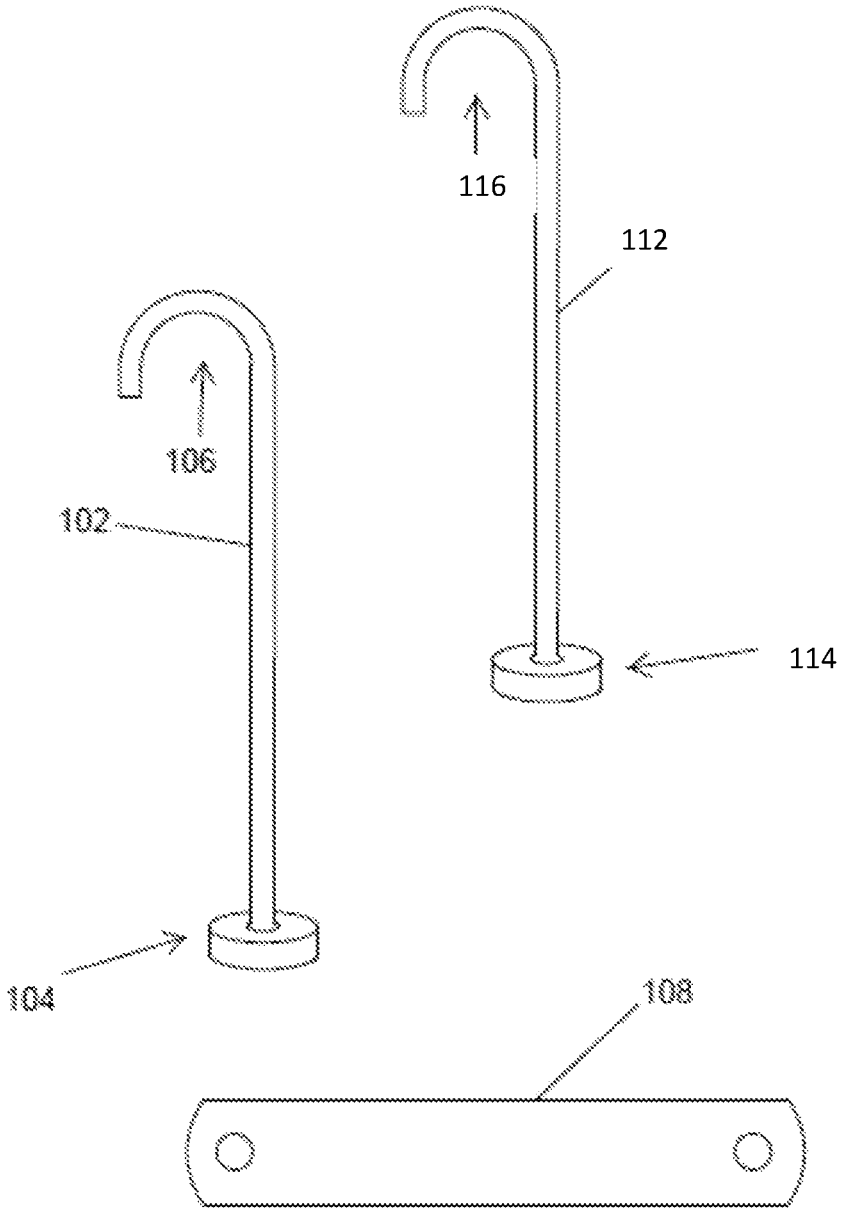
FIG. 2 is a diagram showing a left side elevation view of an example additional toilet paper roll holder with three portions of the example additional toilet paper roll holder shown separately in accordance with some implementations.

In FIG. 2, the first elongated portion 102 with the first curved portion 106 and the first end 104, the second elongated portion 112 with the second curved portion 116 and the second end 114, and a support member 108 with a first slot 110 and a second slot 120, are shown separately.

Figure 3:
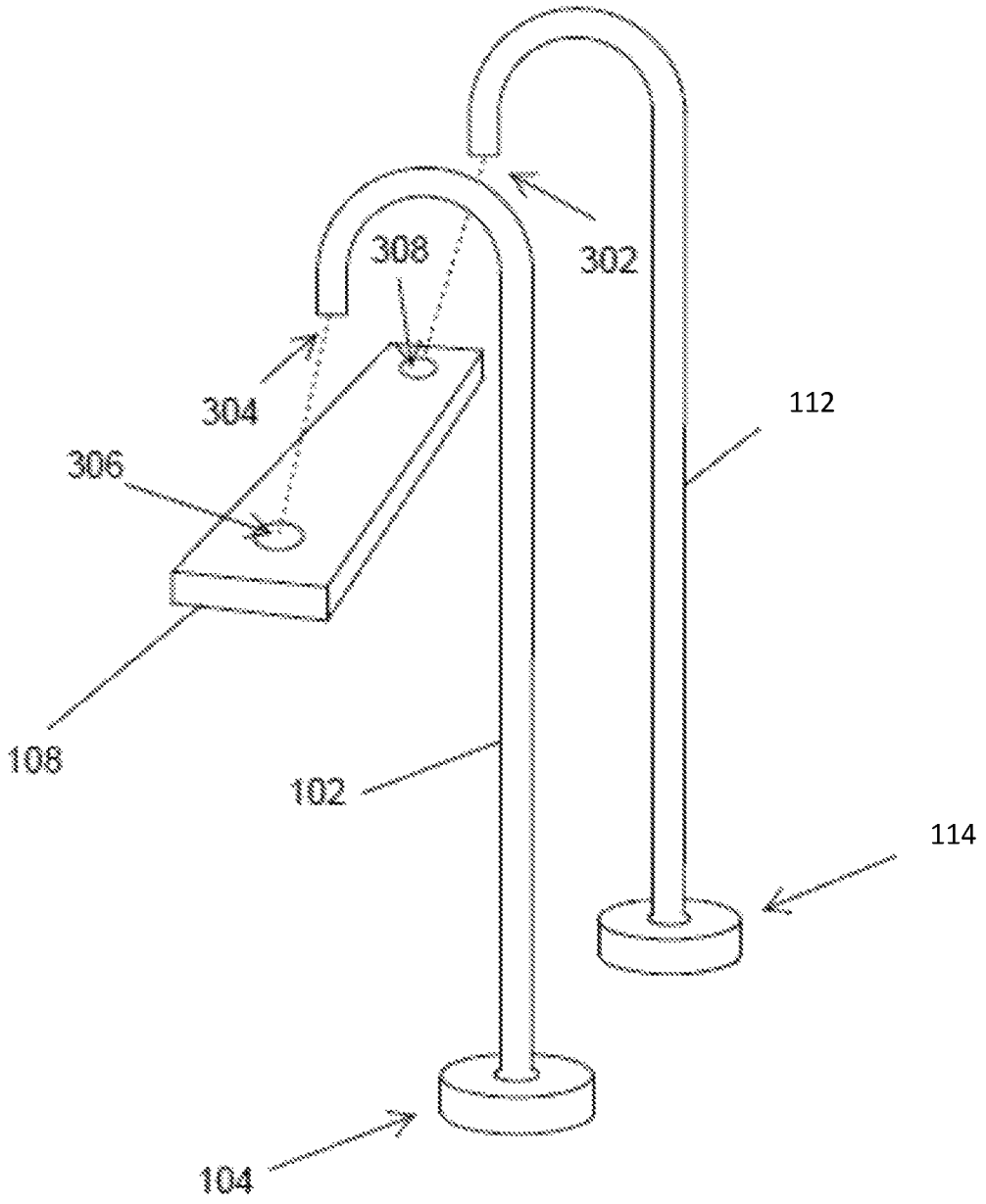
FIG. 3 is a diagram showing a left side elevation view of an example additional toilet paper roll holder with an illustrative path of movement of an example additional toilet paper roll supported by an example support member shown in accordance with some implementations.

In FIG. 3, an illustrative path of movement of the support member 108 is shown, wherein the first slot 110 of the support member 108 can potentially pass through an initial portion 306 of the first curved portion 106 and the second slot 120 of the support member 108 can potentially pass through an initial portion 316 of the second curved portion 116.

The first elongated portion 102 and the second elongated portion 112 can be made of plastic, metal, wood, stone, composite, synthetic, thermoplastic, rubber, textile, plant fiber, natural or man-made materials. The first curved portion 106 and the second curved portion 106 can be made of plastic, metal, wood, stone, composite, synthetic, thermoplastic, rubber, textile, plant fiber, natural or man-made materials. The first end 104 and the second end 114 can be made of plastic, metal, wood, stone, composite, synthetic, thermoplastic, rubber, textile, plant fiber, natural or man-made materials. Also, it will be appreciated that the materials described herein are for illustration purposes only and are not intended to be limiting. Other materials can be used depending on a contemplated implementation.

Figure 4:
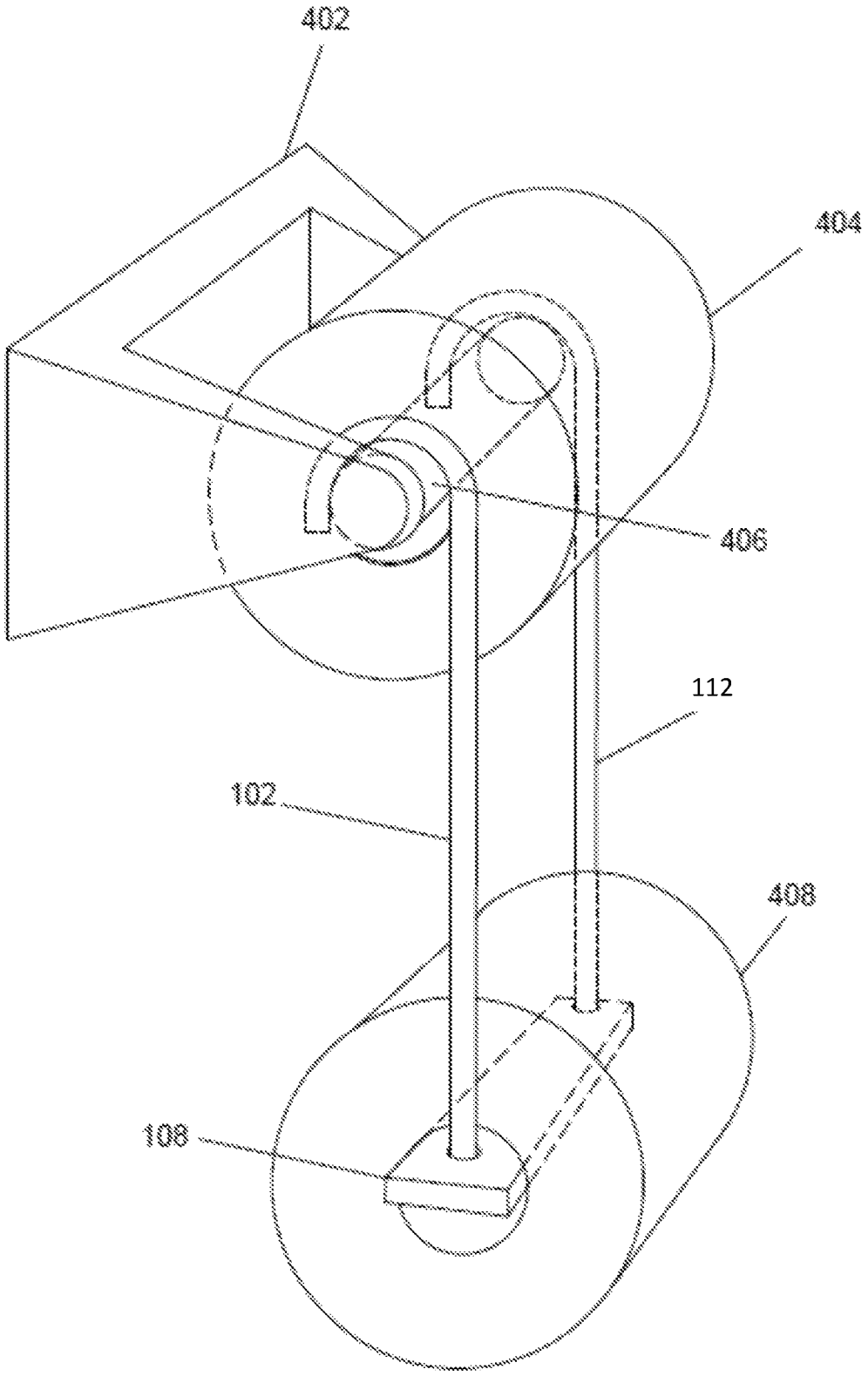
FIG. 4 is a diagram showing a left side elevation view of an example additional toilet paper roll holder along with an example first toilet paper roll and an example additional toilet paper roll in accordance with some implementations.
Figure 5:
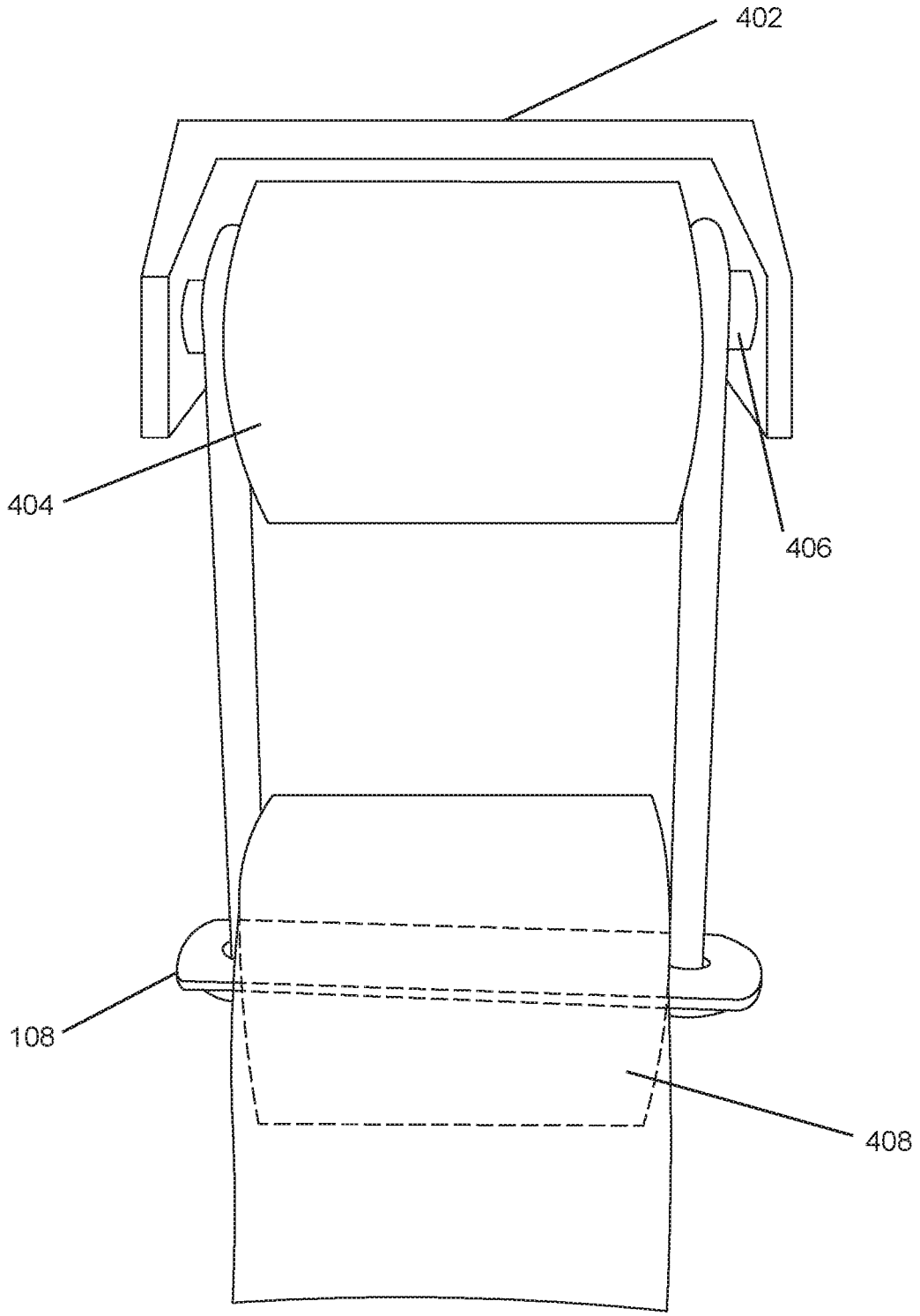
FIG. 5 is a diagram showing a front side elevation view of an example additional toilet paper roll holder along with an example first toilet paper roll and an example additional toilet paper roll in accordance with some implementations.

The additional toilet paper roll holder 100 carries an illustrative additional toilet paper roll 408 in FIG. 4. It will be appreciated that the additional toilet paper roll 408 described herein is for illustration purposes only and is not intended to be limiting. Other types of additional toilet paper rolls can be used depending on a contemplated implementation. In some implementations, the support member 108 is configured to carry the additional toilet paper roll 408. For example, the support member 108 can be inserted into a core of the additional toilet paper roll and support the roll when rested on the first end 104 and the second end 114. The support member 108 can be rested on the first end 104 and the second end 114 by passing the first slot 110 through the first curved portion 106 and the second slot 120 through the second curved portion 116.

FIG. 4 also shows an illustrative toilet paper roll holder 402 with an arm 406 carrying an illustrative toilet paper roll 404. The first curved portion 106 and the second curved portion 116 wrap around the toilet paper roll holder arm 406. It will be appreciated that the toilet paper roll 404 and the toilet paper roll holder 402 with the arm 406 described herein are for illustration purposes only and therefore are not intended to be limiting. Other toilet paper rolls as well as toilet paper roll holders and arms can be used depending on a contemplated implementation.

In some implementations, the first elongated portion 102, the first curved portion 106 and the first end 104 can form a single integrated unit without one or more joints, interfaces, connections, or attachments. In some other implementations, the second elongated portion 112, the second curved portion 116 and the second end 114 can form a single integrated unit without one or more joints, interfaces, connections, or attachments.

In some implementations, the first elongated portion and the second elongated portion are made of a material that is round with a diameter of around ⅜ inch, and the first curved portion and the second curved portion have a radius of around ½ inch. It will be appreciated that any dimensions described herein are for illustration purposes only and are not intended to be limiting. Other suitable dimensions could be used depending on a contemplated implementation.

It is therefore apparent that there is provided, in accordance with the various example implementations disclosed herein, an additional toilet paper roll holder.

While the disclosed subject matter has been described in conjunction with a number of implementations, it is evident that many alternatives, modifications, and variations would be or are apparent to those of ordinary skill in the applicable arts. Accordingly, Applicant intends to embrace all such alternatives, modifications, equivalents and variations that are within the spirit and scope of the disclosed subject matter.

What is claimed is:

1. An additional toilet paper roll holder comprising:

a support member with a first slot and a second slot;

a first elongated portion connecting a first curved portion to a first end; and a second elongated portion connecting a second curved portion to a second end, wherein the first elongated portion with the first curved portion and the second elongated portion with the second curved portion are configured to be connected through the support member, wherein the first curved portion and the second curved portion are shaped in a hook shaped form, and wherein the first end and the second end are shaped in a cylindrical form having a diameter greater than a diameter of the first and second slots, respectively.

2. The additional toilet paper roll holder of claim 1, wherein the first curved portion and the second curved portion each wrap around an arm of a toilet paper roll holder.

3. The additional toilet paper roll holder of claim 1, wherein the first curved portion and the second curved portion each wrap around a toilet paper roll holder.

4. The additional toilet paper roll holder of claim 1, wherein the support member is configured to be inserted into a core of a toilet paper roll.

5. The additional toilet paper roll holder of claim 1, wherein the support member is configured to enable the first curved portion to pass through the first slot and the second curved portion to pass through the second slot.

6. The additional toilet paper roll holder of claim 1, wherein the support member is configured to support an additional toilet paper roll and enable the first curved portion to pass through the first slot and the second curved portion to pass through the second slot.

7. The additional toilet paper roll holder of claim 1, wherein the first elongated portion, the first curved portion, and the first end form a single integrated unit without one or more joints, interfaces, connections, or attachments.

8. The additional toilet paper roll holder of claim 1, wherein the second elongated portion, the second curved portion, and the second end form a single integrated unit without one or more joints, interfaces, connections, or attachments.

9. The additional toilet paper roll holder of claim 1, wherein the first elongated portion and the second elongated portion are made of at least one of plastic, metal, wood, stone, composite, synthetic, thermoplastic, rubber, textile, plant fiber, natural and man-made materials.

10. The additional toilet paper roll holder of claim 1, wherein the first curved portion and the second curved portion are made of at least one of plastic, metal, wood, stone, composite, synthetic, thermoplastic, rubber, textile, plant fiber, natural and man-made materials.

11. The additional toilet paper roll holder of claim 1, wherein the first end and the second end are made of at least one of plastic, metal, wood, stone, composite, synthetic, thermoplastic, rubber, textile, plant fiber, natural and man-made materials.

12. An additional toilet paper roll holder comprising:

a support member with a first slot and a second slot;

a first elongated portion connecting a first curved portion to a first end; and a second elongated portion connecting a second curved portion to a second end, wherein the support member is configured to hold an additional toilet paper roll, wherein the first curved portion and the second curved portion are shaped in a hook shaped form, and wherein the first end and the second end are shaped in a cylindrical form having a diameter greater than a diameter of the first and second slots, respectively.

13. The additional toilet paper roll holder of claim 12, wherein the support member is configured to be inserted into a core of a toilet paper roll and support the toilet paper roll.

14. The additional toilet paper roll holder of claim 12, wherein the first elongated portion, the first curved portion, and the first end form a single integrated unit without one or more joints, interfaces, connections, or attachments.

15. The additional toilet paper roll holder of claim 12, wherein the second elongated portion, the second curved portion, and the second end form a single integrated unit without one or more joints, interfaces, connections, or attachments.

16. The additional toilet paper roll holder of claim 12, wherein the support member is configured to enable the first curved portion to pass through the first slot and the second curved portion to pass through the second slot.

17. The additional toilet paper roll holder of claim 12, wherein the support member is configured to support an additional toilet paper roll and enable the first curved portion to pass through the first slot and the second curved portion to pass through the second slot.

18. A method for carrying an additional toilet paper roll, the method comprising:

inserting a support member with a first slot and a second slot into a core of the additional toilet paper roll;

passing a first curved portion through the first slot of the support member and a second curved portion through the second slot of the support member such that the support member rests on a first end connected to the first curved portion via a first elongated portion and a second end connected to the second curved portion via a second elongated portion, wherein the first curved portion and the second curved portion are shaped in a hook shaped form, and wherein the first end and the second end are shaped in a cylindrical form having a diameter greater than a diameter of the first and second slots, respectively; and wrapping the first curved portion and the second curved portion around a toilet paper roll holder.

19. The method of claim 18 for carrying an additional toilet paper roll, wherein the first elongated portion, the first curved portion, and the first end form a single integrated unit without one or more joints, interfaces, connections, or attachments.

20. The method of claim 18 for carrying an additional toilet paper roll, wherein the second elongated portion, the second curved portion, and the second end form a single integrated unit without one or more joints, interfaces, connections, or attachments.

* * * * *